US007329327B2

(12) United States Patent
Mays

(10) Patent No.: US 7,329,327 B2
(45) Date of Patent: Feb. 12, 2008

(54) METHOD FOR GLUE-BONDING TOOTHBRUSH TO CLOSURE WITH CORRESPONDING GERMICIDAL RECEPTACLE

(76) Inventor: Morris Jeffery Mays, 1611 NW. 50th St., Miami, FL (US) 33142

( * ) Notice: Subject to any disclaimer, the term of this patent is extended or adjusted under 35 U.S.C. 154(b) by 488 days.

(21) Appl. No.: 11/093,246

(22) Filed: Mar. 30, 2005

(65) Prior Publication Data

US 2006/0225839 A1 Oct. 12, 2006

(51) Int. Cl.
*B29C 65/00* (2006.01)

(52) U.S. Cl. ..... 156/293; 206/15.3; 206/209.1; 206/362.3; 132/308; 15/246; 15/248.1; 156/303.1; 156/305; 156/334

(58) Field of Classification Search ..... 206/15.2, 206/15.3, 209, 209.1, 361, 362.2, 362.3; 15/246, 248.1; 156/293, 294, 303.1, 305, 156/334; 132/308
See application file for complete search history.

(56) References Cited

U.S. PATENT DOCUMENTS

| | | | | | |
|---|---|---|---|---|---|
| 1,283,403 | A * | 10/1918 | Eustis | 312/207 |
| 4,108,057 | A | 8/1978 | Hain et al. | 99/452 |
| 4,125,201 | A | 11/1978 | Birch | 215/330 |
| 4,603,066 | A | 7/1986 | Jabarin | 428/36.92 |
| 5,123,765 | A | 6/1992 | O'Connell et al. | 401/126 |
| 5,517,712 | A | 5/1996 | Schiano | 15/167.1 |
| D389,686 | S | 1/1998 | Drage | D6/528 |
| 5,871,613 | A * | 2/1999 | Bost et al. | 156/62.2 |
| 6,088,869 | A | 7/2000 | Kaneda et al. | 15/167.1 |
| 6,090,488 | A * | 7/2000 | Kweon | 428/399 |
| D439,780 | S | 4/2001 | Azo | D6/528 |
| D462,528 | S * | 9/2002 | Crossman et al. | D4/104 |
| 6,702,113 | B2 | 3/2004 | Marino | 206/362.2 |
| 6,715,952 | B1 | 4/2004 | Aiken et al. | 401/282 |
| D497,256 | S * | 10/2004 | Xi | D4/104 |
| 6,851,586 | B2 | 2/2005 | Odet | 222/541.9 |
| 6,854,614 | B2 | 2/2005 | Sprick | 215/329 |
| D502,322 | S * | 3/2005 | Bava et al. | D4/104 |
| 6,860,952 | B2 | 3/2005 | Pawloski | 156/66 |
| 2004/0129580 | A1 * | 7/2004 | Cochran et al. | 206/15.2 |

OTHER PUBLICATIONS

WO 205/016100, Feb. 2005, Fretwell et al.*

* cited by examiner

*Primary Examiner*—John L. Goff

(57) ABSTRACT

Method forming an oral hygiene device with corresponding germicidal receptacle is disclosed; wherein the device can be used to produce transitory oral hygiene devices; wherein the methods entails a toothbrush, a walled center closure, a disk gasket, a corresponding receptacle, a metal filament; wherein the toothbrush handle upper end is inserted through the disk gasket and closure from the bottom, away from the closure top vale, while the lower handle, neck, head and bristle end protrudes downward away from the closure bottom; wherein the toothbrush and closure with disk gasket are perpendicularly aligned where heated glue directed into the vale fuse the surfaces; the metal filament is affix to corresponding receptacle interior creating the germicidal receptacle; wherein practicing the method and a transitory oral hygiene-device structured from the glue-bond, toothbrush, closure, disk gasket, corresponding receptacle with metal filament are also disclosed.

1 Claim, 9 Drawing Sheets

FIG.17
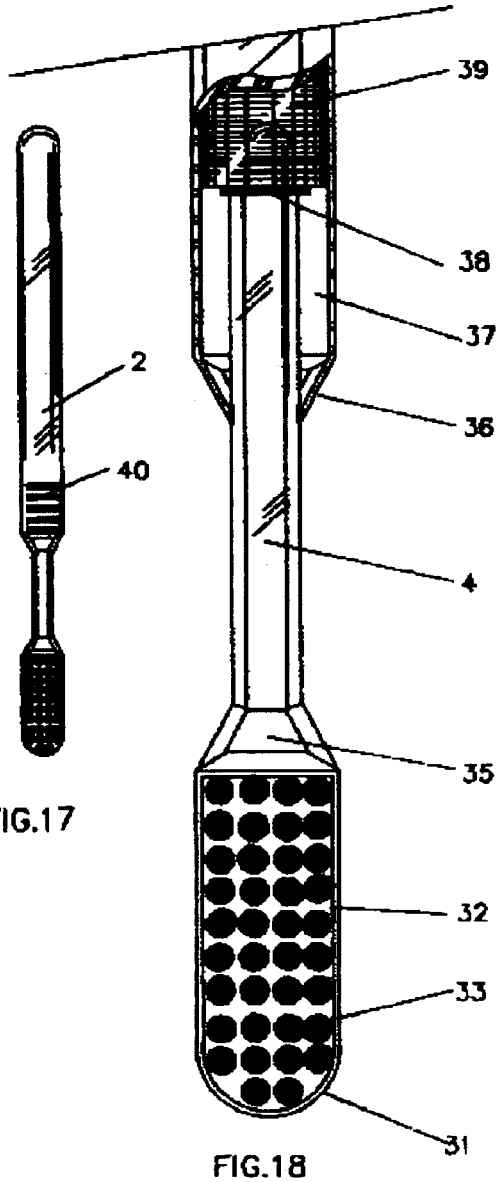
FIG.18
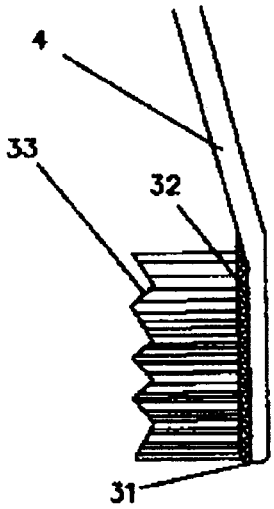
FIG.19

METHOD FOR GLUE-BONDING TOOTHBRUSH TO CLOSURE WITH CORRESPONDING GERMICIDAL RECEPTACLE

DESCRIPTION

1. Field of the Invention

The present invention relates to oral hygiene devices and more particularly to a method for glue-bonding a toothbrush to a closure with corresponding receptacle having a metal (silver, gold, or stainless steel, etc) filament in its cavity producing a transitory oral hygiene device.

2. Description of the Prior Art

Prior art uses of plastic resin to make toothbrushes, glues, and closures with corresponding receptacles are disclosed in high numbers. U.S. Pat. No. 4,603,066, to Jabarin, is one such example which disclosed making poly (ethylene terephthalate) articles in several embodiments using a heat process. Prior art provide closures with corresponding blown plastic bottles widely used in transitory applications, from baby bottles to water and soft drink bottles. A closure device for a container including a pourer designed to be fixed on a neck of the container; wherein the closure device includes a cover assembly adapted to be mounted on the neck and over the pourer is an example disclosed by U.S. Pat. No. 6,851,586, to Odet.

Personal care products, mouthwashes, antiseptics, and lotions, food products, milk, soft drinks, juices, cleaning products, medical and health care products, are primarily offered to consumers in plastic bottles with corresponding closures, many available as 'off the shelf' items. A great majority of these closures and bottles are designed to withstand varying degrees of internal pressure; however, it is commonly expected these bottles and closures be discarded when the containing product is emptied. The prior art as disclosed by U.S. Pat. No. 6,854,614, to Sprick, is an example of a closure having an improved thread design for use on a container having an externally threaded neck. The invention relates to a rotary jumped thread of a closure which allows less removal force which ordinarily distorts the closure during removal from the mold.

Another example of prior art U.S. Pat. No. 4,125,201, to Birch, a closure cap having a top portion and an annular skirt which extends from the periphery of the top portion, the skirt being provided internally with a skirt thread which is adapted to cooperate with an external neck thread on the neck of the container. Said prior art require considerable torque to remove it from the container to ensure the closure cap does not become loose during storage or transit. The present invention discloses a similar closure method for preventing leakage when the device is in stored position and soft enough to prevent injury from coming into contact with the face area. A closure acceptable in molded plastic and or rubber.

Consumers prefer to use a toothbrush they have proven right for their particular oral hygiene interest, which supports reasoning for prior art such as U.S. Pat. No. 6,088,869, to Kaneda, et al., disclosing a toothbrush which is excellent in performance with regard to cleansing of surfaces of teeth and massaging of gums, is comfortable in the sense of feel, and is satisfactory in providing a long service life exist. The prior art reveals a variety of available makes and models with tapered and non-tapered bristles as that of prior art U.S. Pat. No. 6,090,488, to Kweon.

Other prior art disclosing unique designs are U.S. Pat. No. D497,256, to Xi, U.S. Pat. No. D502,322, to Bava, et al, and U.S. Pat. No. D462,528, to Crossman, et al. The present invention can accept most any prior art toothbrush. The present invention acknowledges individual preference in toothbrushes for cleansing performance and massaging effect. Any toothbrush manufacturer can utilize the present invention to offer it's toothbrushes as part of a transitory oral hygiene device. The present invention discloses a toothbrush having unique features such as a metal (silver, gold, or stainless steel, etc) germicidal bristle base for germ and bacteria killing catalytic reaction during use and storage, seven shaped bristle cleaning surfaces, a bull-nosed rounded bristle head which aids in the prevention of injury to innermost mouth areas, a tapered stream-lined angled neck to minimize mouth area injury, a telescoping lower handle from within the upper handle.

Toothbrush prior art discloses many examples boosting to offer a long service life as does U.S. Pat. No. 6,088,869, to Kaneda, et al. The present invention is designed to compliment the life cycles of toothbrushes in accord with recommendations by dental professionals extending from one day of use to as many as sixty days of use. Dental professionals rarely recommend using a toothbrush beyond sixty days; however, consumers are commonly known to practice this unhealthy habit for reasons disclosed by Kaneda, et al, disclosing extended bristle service life. The present invention considers consumer practice which establishes a definite need for this sensible and durable product that is both economical to manufacture as a transitory oral hygiene device, yet durable enough to outlive the life expectancy of toothbrush bristles.

Materials used in the manufacture of toothbrush handles vary; their primary material composition is plastic resin. The present invention uses a heated glue-bonding method to compliment varied toothbrush handle material composition and shape, as the glue application is in heated liquid form upwards of 350 degrees, softening the plastic surface material of the toothbrush handle and the closure to effect a bonding action with the glue, forming a permanent airtight seal as disclosed in prior art U.S. Pat. No. 5,871,613, to Bost, et al., which utilizes glue-bonding scrim to a fiber mat, opposed to stitching, preventing piercing of the scrim as can be caused when using a Fales stitching machine. Bost, et al, points out scrim that is simply needle stitched to the fiber mat is not firmly attached and is prone to becoming separated from the fiber mat. Prior art examples of glue-bonding are diverse.

The present invention uses heated glue-bonding to prevent leakage around the union of the toothbrush handle which vary by design, many having a plurality of sides, opposed to applying special individual tooling processes to prevent leakage around this union as being costly to accomplish and not practical in the method of manufacture for an affordable transitory oral hygiene device. Another example of prior art use of glue in its manufacture is U.S. Pat. No. 6,860,952, to Pawloski, disclosing a method for forming a thermoplastic film with an attached closure strip, where the hot binder layer transfers enough heat to the closure strip and to the film web to melt the closure strip binding surface and the film web sealing surface. Pawoloski also included an apparatus for practicing the method and a reclosable bag formed from the thermoplastic film with attached closure strips.

Yet another prior art U.S. Pat. No. 4,108,057, to Hain, et al, discloses advantages using constructed glue-bonded sheet layers of synthetic resin or the like to formulate a device for continuous production of cheese materials.

Economics plays strong in the decision for consumers to continue to use a toothbrush beyond its recommended life cycle, ownership rights has its place and much to do with this habit of consumers as well discovered in the prior art. The consumer majority refer to the toothbrush they use as 'my toothbrush', suggesting ownership. Only in very rare instances is it heard a consumer using another's toothbrush, only then by accident from the method used when stored.

The present invention is a transportable transitory oral hygiene device with single toothbrush storage capability; however, prior art provides examples of toothbrush holders and storage devices with capacity to hold one or more toothbrushes. U.S. Pat. No. D439,780, to Azo, discloses a bottle for holding an antiseptic solution with an attached container for holding one or more toothbrushes. The device is not disclosed as being transportable as is the present invention.

Another, U.S. Pat. No. D389,686 to Drage, discloses a toothbrush holder with a clock on one of it's sides, having spaces for one or more toothbrushes on it's top side. These two prior art examples are of stationary type, not meant to be transportable or transitory; neither comes with a toothbrush glue-bonded or otherwise to it's closure as does the present invention.

Prior art U.S. Pat. No. 6,715,952, to Aiken, et al, discloses a self-contained portable and disposable toothbrush with dehydrated toothpaste and a plastic bubble containing water mounted on one side so to provide use of the toothbrush in locations where drinkable water is not accessible. The present invention does not claim providing dehydrated toothpaste, neither does it claim an interchangeable toothbrush nor toothbrush head; however the present invention does claim providing a means of protecting the bristles of the toothbrush in a liquid between uses which this prior art does not state a claim.

Storing toothbrush bristles away from insects, dirt, bacteria, airborne germs and viruses is considered good oral hygiene practice and recommended by dental and health professionals. Prior art offers a variety of toothbrush storage devices for protection of toothbrush bristles between uses. The present invention draws reasoning from prior art while addressing and providing solutions to important concerns omitted from their disclosures. Prior art U.S. Pat. No. 5,517,712, to Schiano, offers similar benefits as the present invention; however, Schiano discloses a portable toothbrush and mounting stand which accommodates renewable changeable bristles which are discarded when past their time of effectiveness and to maintain the toothbrush sanitarily and hygienically. It does not provide a method for protecting the toothbrush bristles between uses, nor does it offer the use of varied manufacturer's toothbrushes as a major component, though it does accommodate various sized bristles and firmness, it does not have germ killing benefits. The present invention discloses a toothbrush having unique features such as a metal (silver, gold, or stainless steel, etc) germicidal bristle base for germ and bacteria killing catalytic process during use and storage, shaped bristle cleaning surfaces, a bull-nosed rounded bristle head which aids in the prevention of injury to innermost mouth areas, a tapered stream-lined angled neck to minimize mouth area injury, a telescoping lower handle from within the upper handle, and those offered by favored manufacturer.

The present invention offers a method for protecting the bristle portion from contaminants between uses while offering a sensible method for sanitizing the bristles and oxidizing the liquid, carrying or storing the toothbrush in a purse, a drawer, or on a flat surface, being transitory. With the present invention, you do not change bristles after their useful life has expired; you replace the entire device, or replace the toothbrush in closure apparatus of the device.

Prior art U.S. Pat. No. 5,123,765, to O'Connell, et al, discloses a disposable toothbrush provides an elongated handle thread able onto the brush member having a duct for carrying toothpaste. Disposable toothbrushes as depicted by this prior art can be quite different in their manufacture and uses. The present invention does not claim a tubular handle for providing toothpaste, it does claim a telescoping lower handle and being transitory, as well as providing a toothbrush which has been selected for use by the user for its appeal as to bristle type, bristle shape, bristle purpose, color, handle shape, and even favored manufacturer, with its' own antiseptic sanitizing and liquid oxidizing, storage part, neither of which is claimed by this prior art.

Toothbrush holders, those using antiseptic solutions as a means of sanitizing, transportable sanitizing devices, transitory oral hygiene devices, are known to the prior art. Dental professionals recommend the use of these devices. They are portable providing leak resistance for carrying when the need arises, and some are meant to remain stationary, as they are without means for containing a liquid without leaking. Some are both portable and stationary as is the present invention. One referenced Prior Art U.S. Pat. No. 6,702,113, to Marino, closest to the present invention, provides a toothbrush that is integral to the cover. This prior art relates to an assembly for storing one or more toothbrushes in a receptacle, as does other herein referenced prior art; however, neither Marino nor referenced prior art discloses a germicidal catalyst as does the present invention. The present invention stores a single toothbrush. It is not disclosed under the patent whether Marino intended his Prior Art to be disposable; however, Marino does claim having a detachable toothbrush and receptacle, and while this is disclosed, Marino claims a receptacle cover is an integral part of the toothbrush and is attached to the neck (toothbrush) thereof. Marino discloses the closure be large enough with a conical shape to prevent tooth brushing runoff on the users arm area, where the present invention has concluded this approach increases the risk of injury from closure contact with the users face and mouth area. The present invention differs to Marino in this and other areas as disclosed. The present invention assumes Marino has the ability to accept any prior art toothbrush as well, even though it is not claimed or disclosed by Marino. The present invention is patent-ably distinguishable over the prior art including those discussed herein as it requires a heated glue-bonding process, offers a telescoping toothbrush handle with a germicidal bristle base and a germicidal receptacle having a metal (silver, gold, stainless steel, etc) filament within its cavity area with a soft plastic or rubber corresponding closure for prevention of face and/or mouth injury while in use, while accepting most prior art toothbrushes. The germicidal qualities of the present invention is distinguishably different and unique to the prior art.

SUMMARY OF THE INVENTION

It is an object of this invention to be for temporary use of 2 months or less.

It is an object of this invention to provide a sterile toothbrush each time it is used.

It is an object of this invention to sanitize and germicide a single toothbrush.

It is an object of this invention to be portable.

It is an object of this invention to provide a toothbrush where its neck and bristles are protected from un-intentional contact with bugs, flies, ants, airborne particles, germs, bacteria and touch in its stored position.

It is an object of this invention to provide a receptacle for both containing antiseptic for sanitizing and a catalyst for promoting germ elimination thereby protecting the toothbrush head with bristle portion in its stored position.

Another of this invention's objects is to utilize commercially accepted stock toothbrushes as well while many toothbrush manufacturers have invested years at perfecting their toothbrushes addressing various consumer oral hygiene needs, a process plausibly too costly to reproduce.

It is an object of this invention to offer an economical method to toothbrush manufacturer's to produce transitory oral hygiene devices.

The invention herein summarized includes the methods of constructing hereinafter described and indicated within each subjoined claim by referencing the accompanying drawings, where at least one of various possible embodiments of this invention is illustrated, a more complete understanding of this invention may be realized.

BRIEF DESCRIPTION OF DRAWINGS

FIG. 17 is an elevational view of the telescoping necked germicidal toothbrush (25) showing the varied telescoping head adjustment positions (40) below the handle middle portion (2) according to the principles of the present invention.

FIG. 18 is an exploded sectional detail view of the telescoping necked germicidal toothbrush (25) showing the inner workings of the telescoping features and a close up view of the silver faced bristle head (32) area wherein the upper neck end is a shaft rod (39) which slides up and down within the inner toothbrush handle (37) as positioned by pressing down on the neck locking lever (38) while pulling outwardly or pushing inwardly on the telescoping neck (4) and silver faced head (5) according to the principles of the present invention.

FIG. 19 is a right side elevational view of the neck (4), rounded end head (31), silver faced head (32) and shaped bristle portion (33) according to the principles of the present invention.

BEST MODE FOR CARRYING OUT THE INVENTION

Figure 1:
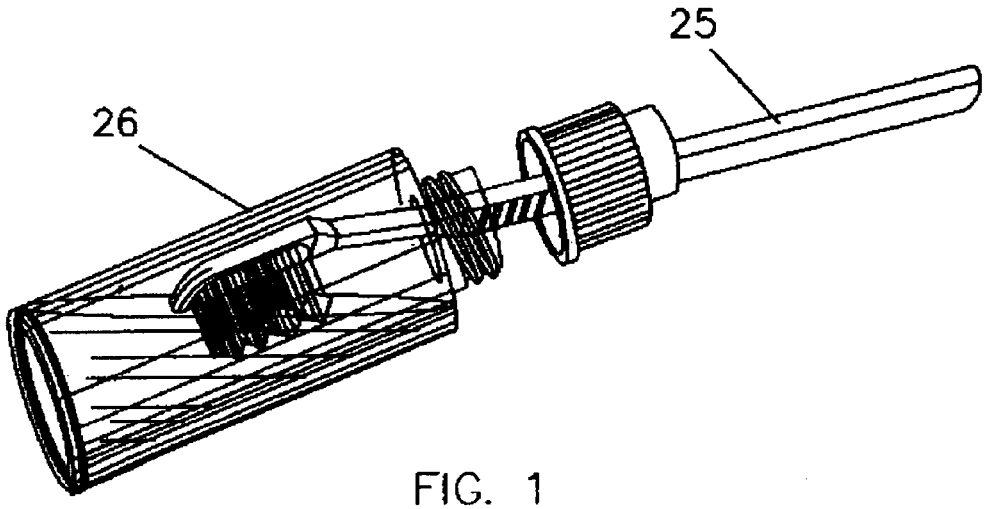
FIG. 1 is a perspective view taken from the side of the transitory oral hygiene device showing the closure with telescoping toothbrush (25) and clear plastic germicidal bottle with positioned silver filament (26) around the interior base within liquid antiseptic (6).

The method for structuring the present invention entails several steps where a variety of arrangements and layouts are possible.

1. Obtaining the stock toothbrush (23) that will be used for the manufacturing run.

A particular toothbrush (23) run will ordinarily provide a sample of the toothbrush to be used in the run.

A toothbrush (23) can have many different types of handles requiring evaluation before ordering a closure and its corresponding necked bottle. The closure (22) center opening (16) diameter required for the run must be of a size and type that will accommodate the toothbrush handle (1), as unique as it may be. The present invention finds that most toothbrush handles (1) will fit into a ⅝ inch diameter center opening with enough play for aligning the toothbrush head (5) to fix vertically into the bottle cavity (9) through the neck (10) creating the interior toothbrush handle wall (28) surface of the top (15) closure vale required to accept the heated glue (13) for the bonding process.

2. Obtaining the preferred closure (22) that will be use for the manufacturing run.

Figure 2:
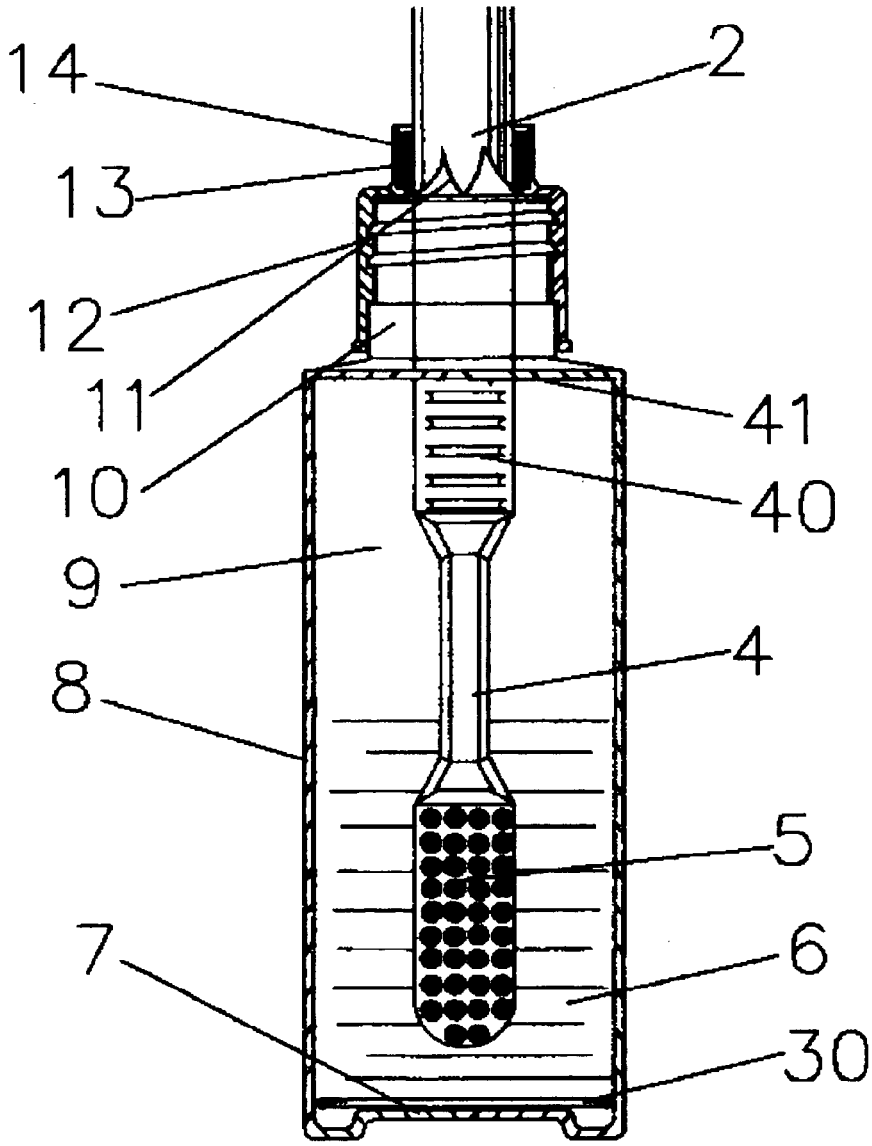
FIG. 2 is a cross sectional view through the soft closure (12), the glue filled vale (13) inside the closure stack (14) where the toothbrush middle handle (2) passes through the center of the star disk gasket (11) down into the bottle neck (10) beyond the bottle shoulder (41) into the upper bottle cavity (9) where the toothbrush handle lower end with telescoping adjustment part (40), extended telescoping neck (4), and silver faced rounded head bristle portion (5) is stored within the plastic bottle (8) lower cavity near the silver germicidal filament (30) affixed at the interior base (7), in the oxidized liquid antiseptic (6).
Figure 3:
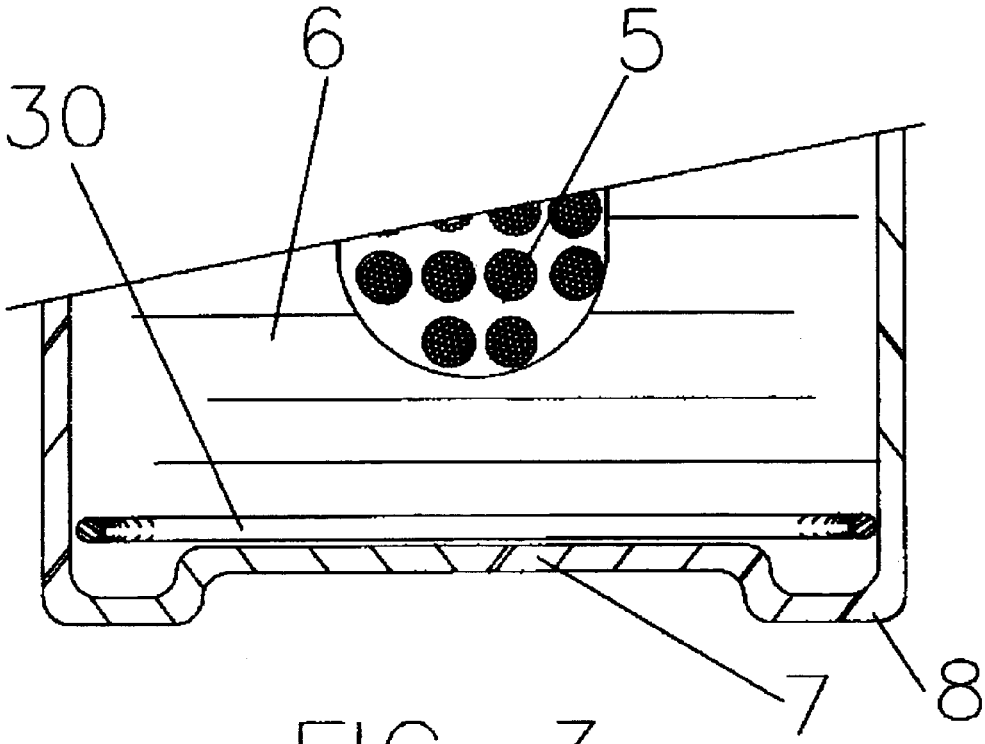
FIG. 3 is an exploded cross sectional view of the toothbrush silver faced rounded head bristle portion (5) stored within the plastic bottle (8) lower cavity near the silver germicidal filament (30) affixed at the interior base (7), in the oxidized liquid antiseptic (6).
Figure 4:
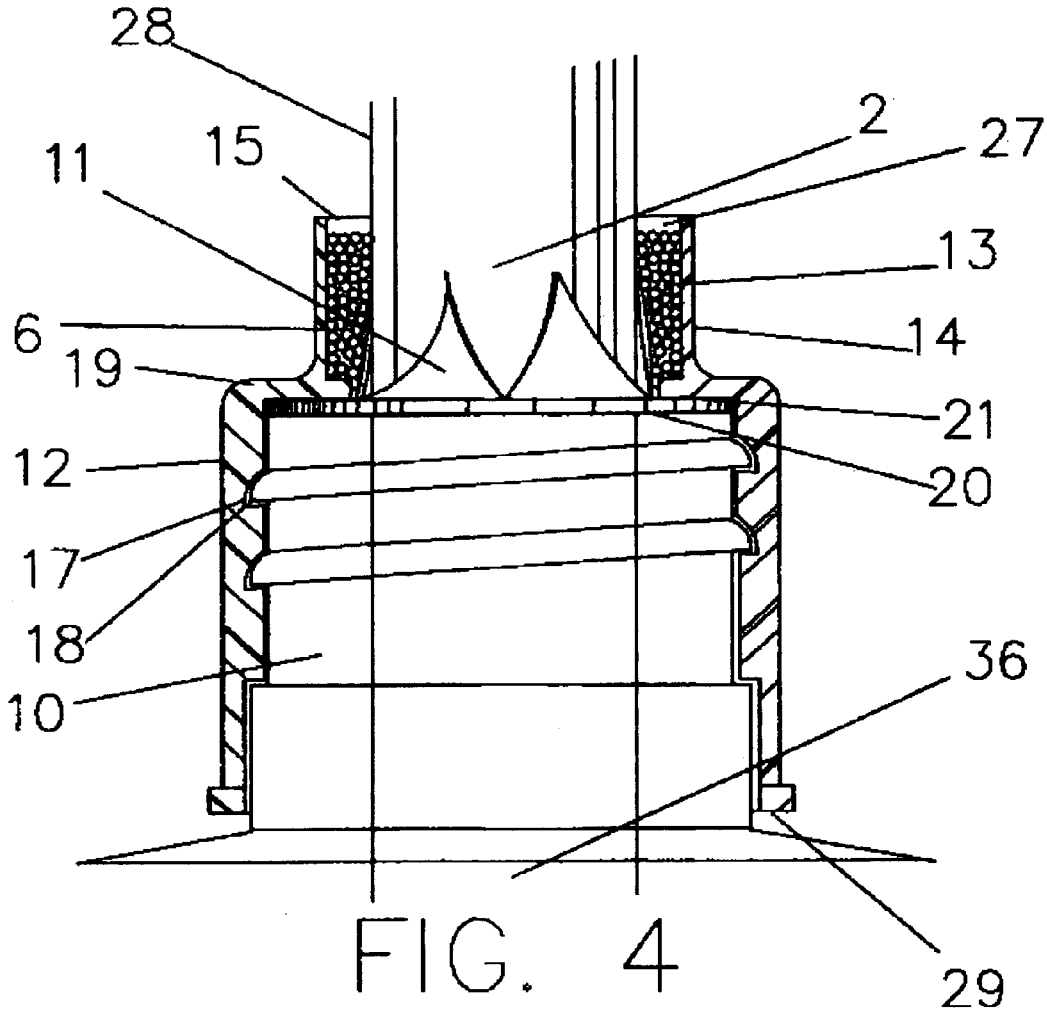
FIG. 4 is a detailed cross sectional view through the closure (12) and bottle neck (10) showing the toothbrush middle handle (2) within the closure top vale (15) filled with glue (16) between the closure top interior wall (13) and star centered disk gasket flags (11) where the water and air-tight bonded is created to form the oral hygiene tool (25).
Figure 5:
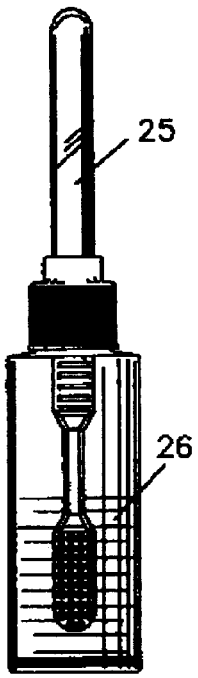
FIG. 5 is a front elevational view of an embodiment of the device according to the principles of the present invention.
Figure 6:
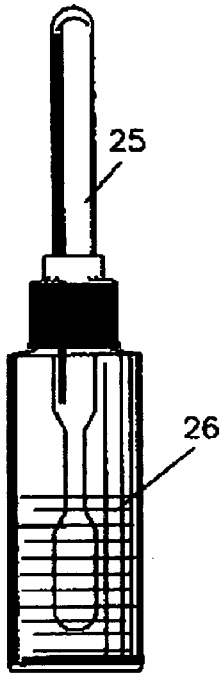
FIG. 6 is a rear elevational view of an embodiment of the device according to the principles of the present invention.
Figure 7:
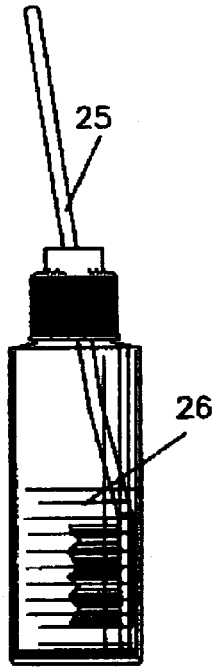
FIG. 7 is a right side elevational view of an embodiment of the device according to the principles of the present invention.
Figure 8:
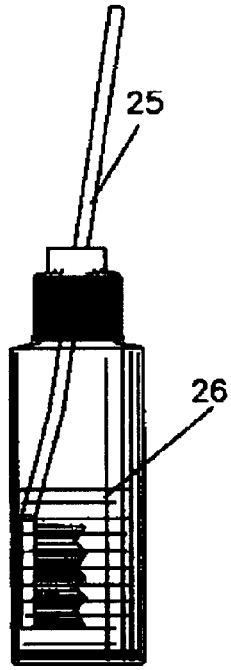
FIG. 8 is a left side elevational view of an embodiment of the device according to the principles of the present invention.

A particular type of closure (22) used in part for the manufacture of forced air spray pump types is preferred by the present invention over flat top closures and some others. The present invention finds a closure of the forced air type with matching disk gasket (a customized disk gasket having a split star center section will provide a more suitable seal for preventing the heated glue to flow to the underside of the gasket to the lower toothbrush handle), having a raised top section (15) and protruding end wall section (14) on the closure's center opening bottom (21), with a 24/410 finish, provides the most complimentary means for the required glue bonding process, assuring a leak proof seal each run, and outside dimensions most favorable for interference and injury free brushing. (Closures larger in diameter than the 24 mm recommended with this present invention will increase the chances of causing mouth injury to the user.) Referring to FIG. 2, the present invention closure bottom, because of its small outside diameter and middle position on the toothbrush handle (2), will capture some runoff from brushing; however, it is not the intent of the present invention to eliminate the tooth brushing runoff on the user's hand or forearm area. The proper method for using a toothbrush is to repeat the rinsing of the bristles during the brushing cycle to assure removal of food particles that may have gathered on the bristles while brushing, a primary objective of brushing the inner mouth areas.

3. Obtaining the blown plastic bottle (24) that will be use for the manufacturing run.

Prior to ordering the bottle with a specified neck opening and style, as prior art blown plastic bottles are as varied as toothbrushes, the toothbrush neck (3), head and bristle end (5), must be considered and evaluated. The toothbrush head and bristle end (5) and neck (3) must fit into and down through the bottle neck (10) opening. The toothbrush head and bristle end (5), neck (3), must be aligned and fixed centrally in the bottle cavity (9) area, away from the walls (8) and bottom (7) of the bottle. The present invention finds it necessary to position the tip of the toothbrush head and bristle end (5), neck (4), centrally in a downward direction furthest from the bottle neck (10) at a distance of ¼ inch from the bottle bottom (7) surface to allow free movement between the bottle walls (8) and bottle bottom (7) of any liquid (6) contained in the bottle cavity (9). This present invention in an embodiment for purposes of this disclosure, provides for a 4 ounce liquid capacity blown plastic PVC bottle (24) with an approximate 4.796 overall height of any shape having a 24 mm diameter neck outside dimension and a 410 finish when the manufacturing run is for adult toothbrushes (23) with a length of approximately 7¼ inches. The present invention points out the overall height of the bottle is critical to the location of the toothbrush head (5) from the bottom of the closure (29). If the closure bottom (29) or sides (12) are too close to the toothbrush head and bristle end (5), and neck (4), the closure (22) will interfere with relaxed brushing, being placed into contact with the user's mouth during use causing possible injury. The toothbrush head and bristle end (5), and neck (4), most advanced end must extend a distance of 4¼ inches from the top of the bottle neck (20) top part in contact with the closure disk gasket (11) bottom, down into the bottle cavity (9) for improved safety, minimizing the risk of making closure contact with the user's mouth while brushing.

4. Fashioning the silver, gold, or stainless steel filament (30) that will be use for the manufacturing run.

The antibiotics properties of silver are well known to science and medicine. Heterogeneous catalyst research is based in this basic understanding. In the late 1800's in the United States, a silver dollar kept in a milk container served to retard milk spoilage. Silver is known to accelerate healing among burn victims. The present embodiment prefers and uses a 5 inch long gauged silver wire filament (30), (other metal types and shapes can be utilized for this purpose) that has been molded in a circular fashion to provide a spring action resistance when tightly rolled and inserted through the bottle mouth and released about the bottle base causing the filament to spread or un-roll in an outward fashion held in fix position by opposing force exerted by the bottle wall area. The present embodiment accepts a spring-loaded filament (3). The metal filament design and application is relative to the embodiment.

Silver has been used for thousands of years, as early as the $4^{th}$ millennium BC as ornaments and utensils, thus silver is the preferred metal filament of the present invention as it is ductile and malleable (slightly harder than gold) with the highest electrical conductivity and thermal conductivity of all metals, and a common oxidation state of +1 and +2. Stable in pure air and water, silver will tarnish when exposed to ozone, hydrogen sulfide, or air with sulfur in it. The malleability and non-toxicity of silver make it useful in dental alloys for fittings and fillings; additionally, catalytic properties of silver make it ideal for use as a catalyst promoting the required reaction for the present invention. As a catalyst in the present invention, silver modifies the liquid antiseptic or water transition state to lower the activation energy, which is the energy in kilojoules needed for one mole of reactants to react where Δdelta means difference, and H stands for heat which is a measure of energy as Δdelta H, usually given in units of KJ (kilojoules) or thousands of joules. A reaction may have a positive or negative ΔH. The silver filament in the present invention produces a negative ΔH when a liquid antiseptic or water is placed within the bottle cavity, and, being in contact with the filament as the substance that accelerates the rate of a chemical reaction, without itself being transformed or consumed by the reaction, provides the desired effect. No outside source or exothermic assistance is needed to produce a reaction because the silver filament reduces the energy required for the reaction to occur as noted in the accompanying equation where C represents the catalyst:

A+C□"AC (1)

B+AC□"AB+C (2)

Although the catalyst (C) is consumed by the reaction 1, it is subsequently produced by reaction 2, and the overall reaction where the catalyst is neither consumed nor produced is:

A+B+C□"AB+C

Silver used in the present invention is composed of the two stable isotopes Ag-107 and Ag-109 with Ag-107 being the most abundant at 51.839% and is not toxic having germicidal effects and kills many microbial organisms without causing noticeable harm to more complex life-forms. Silver plays no natural biological role in humans and in the present invention essentially produces similar results to that of catalytic converters breaking down much more damaging byproducts in automobile exhaust systems which uses platinum and rhodium as its metal catalyst. Generally, catalysts are solids and their reactants and products are gases or liquids (6). To effect a reaction, one or more of the reactants must diffuse to the catalyst surface (30) and adsorb onto it, desorbing from the catalyst surface after the reaction has occurred.

In the present invention silver only speeds up the germ killing, bacteria destroying, sterilizing reaction being caused by the liquid antiseptic or water in the bottle cavity which ordinarily occurs too slowly to be observed or of little use to the process without the filament.

5. The process of structuring the present invention.

A heated glue apparatus with an adjustable temperature range from 200 degrees F. to 500 degrees F. for hot melt adhesive with a needle nose applicator tip is set into position over a passing recurring conveyor having an adjustable height of 36 inches above the finished floor elevation.

A passing conveyor system of the seat type is positioned to encircle the industrial pneumatic bulk applicator, passing below the needle nose tip open end where it is preset to stop in succession to allow automatic heated glue-bonding adhesive from the needle nose tip to be injected into the closure top and toothbrush handle pan area filling to a predetermined thickness.

The conveyor carries the glue filled vale (27) area immediately through a cooling apparatus which instantly cools the heated glue to a state where the finished toothbrush in closure (25) is removed and inserted in an awaiting corresponding blown plastic germicidal bottle 24 created from a corresponding plastic bottle (24) with a gauged silver spring filament (30) inserted into its lower cavity).

The joined toothbrush and closure (25) with bottle (24) is placed on an opposing conveyor system carrying it through manual inspection where it is removed from the conveyor, squeezed to test whether or not air is allowed to escape either around the pan area or the threaded area of the bottle (10) and closure (22).

If there is found air escaping the closed device, it is placed in a holding area for correction prior to being forwarded through to the labeling and packaging process.

Figure 9:
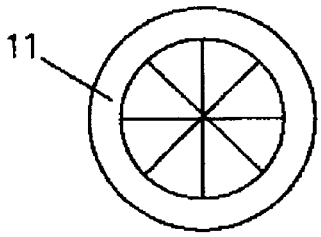
FIG. 9 is a plan view of the split star centered disk gasket (11) according to the principles of the present invention.
Figure 10:
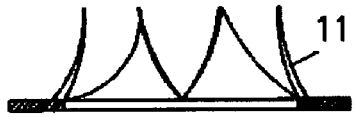
FIG. 10 is an elevational view of the split star centered disk gasket (11) according to the principles of the present invention.
Figure 11:
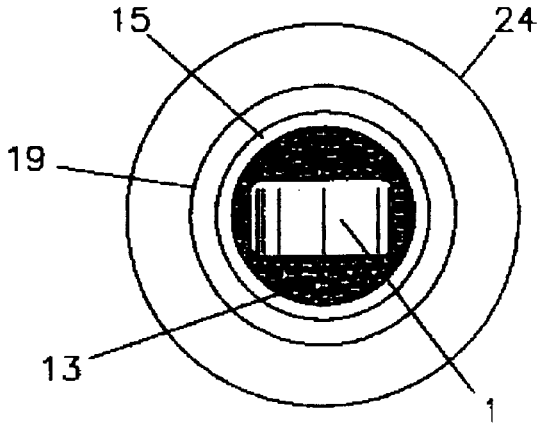
FIG. 11 is a plan view of an embodiment of the device showing the toothbrush upper handle (1) upwardly from the glue filled vale (13) inside the closure stack (15) above the closure top (19) which is seated on the split centered disk gasket (11) pressed to the top of the bottle neck (10) (not seen) joined to the bottle (24) upper shoulder (41) according to the principles of the present invention.
Figure 12:
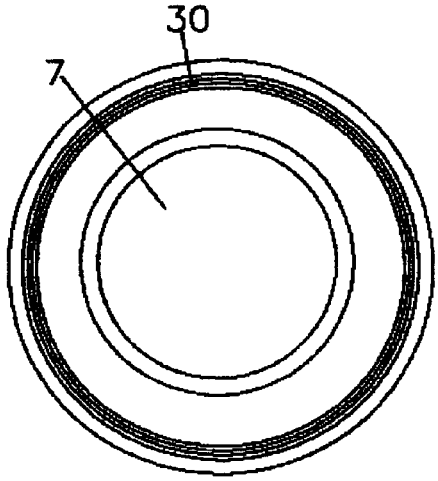
FIG. 12 is a bottom view of an embodiment of the device showing the silver germicidal filament (30) within the bottle base (7) according to the principles of the present invention.
Figure 13:
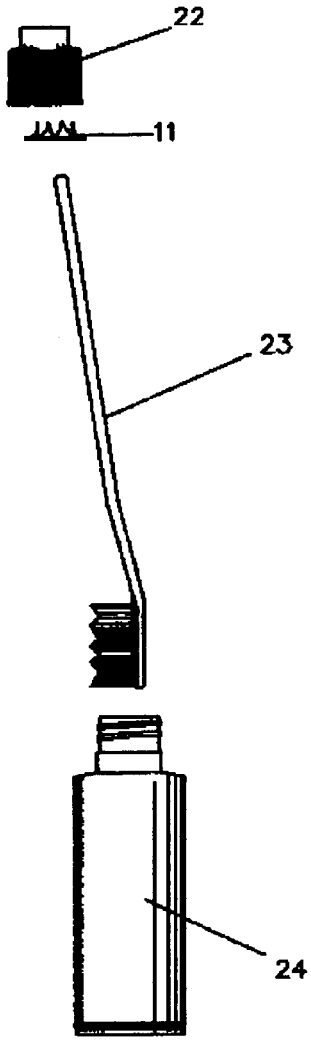
FIG. 13 is an exploded right side elevational view of the embodiment assembly positions according to the principles of the present invention.
Figure 14:
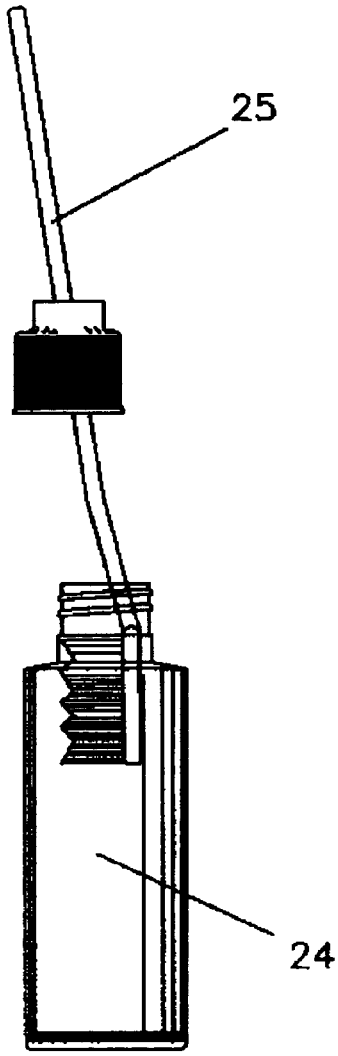
FIG. 14 is a right side elevational view of the oral hygiene tool (25) partially within the germicidal bottle of an embodiment of the device according to the principles of the present invention.
Figure 15:
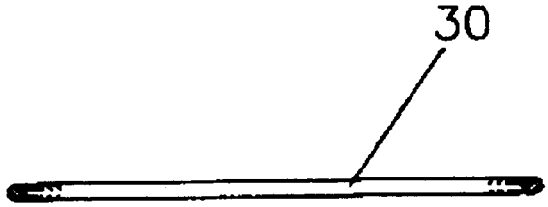
FIG. 15 is a elevational view of the silver germicidal filament (30) according to the principles of the present invention.
Figure 16:
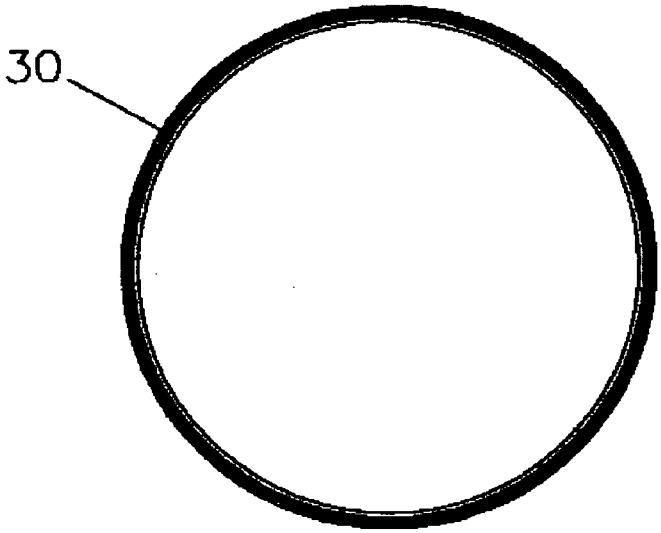
FIG. 16 is a plan view of the silver germicidal filament (30) according to the principles of the present invention.

Air tight devices (FIG. 9) are forwarded through for labeling and packaging.

INDUSTRIAL APPLICABILITY

A method is disclosed for attaching a toothbrush (13) to a closure (22) and star centered gasket (11) with corresponding plastic germicidal bottle (24) where a germicidal filament (30) has been mechanically embedded within a plastic bottle cavity, all particularly used in the manufacture of a transitory oral hygiene device.

What is claimed is:

1. A method for glue-bonding a toothbrush to a closure comprising:

(a) providing a soft surface plastic or rubber closure device for a corresponding necked bottle for storing a liquid having a walled center opening, a split star center disk gasket, and a center vale;

(b) providing a bottle having a neck, shoulder, wall area, and bottom;

(c) providing a toothbrush having an upper handle, middle handle, lower handle with built-in neck adjustment part, an adjustable telescoping neck portion, a rounded catalytic head comprising a metal face area, a plurality of tufted and tapered bristles with one opposing end embedded to beneath the metal face area to a predetermined depth into the head;

(d) providing a heated glue applicator;

(e) providing glue sticks or slats of A-B-A block copolymer where A is a mono-vinyl aromatic hydrocarbon and B is either a conjugated diene or a rubbery mono-olefin with at least one tackifying resin which serves to extend the adhesive properties of the system, at least one stabilizer and at least one oil diluent to produces bonds with varying combinations of low and high temperature adhesion and flexibility as well as high bond strength;

(f) positioning said toothbrush upper handle portion in through the closure bottom to extend upwardly through the closure walled center opening allowing the lower handle, neck, head and bristle end to extend downwardly below the closure bottom at a length for immersing the lower handle, neck, head, and bristle end of the toothbrush through the bottle neck top center, downwardly beyond the neck bottom at the shoulder, downwardly through the upper wall area to within the lower bottle interior towards the bottle bottom resting a minimum ¼ inch from the bottle bottom into sterilizing solution or water for anti-contamination when stored; and (g) fusing the toothbrush handle to the closure center wall by filling the center vale with the glue from the heated glue applicator to form a leak proof seal.

* * * * *